United States Patent [19]

Davis

[11] 4,059,099

[45] Nov. 22, 1977

[54] RESUSCITATIVE DEVICE

[76] Inventor: Belford L. Davis, 4428 Worth Drive, West, Jacksonville, Fla. 32207

[21] Appl. No.: 723,580

[22] Filed: Sept. 15, 1976

Related U.S. Application Data

[63] Continuation-in-part of Ser. No. 676,419, April 13, 1976, abandoned.

[51] Int. Cl.[2] ..... A61H 31/00

[52] U.S. Cl. ..... 128/28; 128/51; 9/14

[58] Field of Search ..... 128/28, 51, 60, 67, 128/54, 55; 9/14

[56] References Cited

U.S. PATENT DOCUMENTS

| | | | |
|---|---|---|---|
| 1,050,836 | 1/1913 | Jones | 128/60 |
| 3,219,031 | 11/1965 | Rentsch | 128/51 |
| 3,228,392 | 1/1966 | Speyer | 128/55 |
| 3,401,686 | 9/1968 | Edwards | 128/28 |

*Primary Examiner*—Lawrence W. Trapp
*Attorney, Agent, or Firm*—George H. Baldwin; Arthur G. Yeager

[57] ABSTRACT

A floatable device having hollow tubular handles, a flat C.P.R. pad spaced laterally and medially of the handles to provide sufficient clearance between the hands of a user and a patient's body in contact with the pad during reciprocating movement of the device, separators on the handles to accommodate the fingers, laterally extending stops equidistant from the pad so that equal pressure may be applied by the user, stops contacting the patient's body to limit the depression of the pad into the victim's body, and a bulbous choke-relieving pressure pad generally opposite to the flat pad.

The device may include an indicator to inform a user that a sufficient pressure is being applied by the C.P.R. pad against a patient's body.

19 Claims, 11 Drawing Figures

RESUSCITATIVE DEVICE

CROSS REFERENCE TO A RELATED APPLICATION

This application is a continuation-in-part of my copending application Ser. No. 676,419, filed Apr. 13, 1976, entitled Resuscitative Device, now abandoned.

BACKGROUND OF THE INVENTION

1. Field of the Invention

This invention relates to a resuscitative device and more particularly to a cardio-pulmonary resuscitator combined with an airway object clearing resuscitator for patients choking on food or other objects. "Airway", as used herein, is defined to refer generally to the pharynx, larynx and trachea of a patient, i.e., wherein air is unable to pass between the nose and/or mouth and the lungs.

2. Description of the Prior Art

There are many cardio-pulmonary massage apparatus, respiratory aids and the like body engaging devices, among which are those shown in the following U.S. Pat. Nos. 793,527—King; 1,050,836—Jones; 1,091,310—Dunn; 2,463,728—Wallin; 3,219,031—Rentsch, Jr.,; 3,228,392—Speyer; 3,401,686—Edwards; and 3,750,654—Shiu. Conventional techniques for emergency or manual cardio-pulmonary resustitation (C.P.R.) are well known and need not be repeated herein. Also, the Heimlich Maneuver technique to prevent food or other object choking fatalities is well known and described in the literature (See *Journal of American Medical Association,* Volume 234, No. 4, Oct. 27, 1975, pages 398–401, "A Life-Saving Maneuver to Prevent Food-choking", by Henry J. Heimlich).

There are several problems with the use of the prior art devices and/or in administering the life saving techniques recommended for C.P.R. and chocking victims or patients, and this invention is directed to alleviating some of the problems with such devices as well as increasing the effectiveness of the first aid techniques in life saving procedures.

SUMMARY OF THE INVENTION

In accord with this invention a resuscitative device for cardio-pulmonary resusciation (C.P.R.) includes an elongated member having opposite end portions, the end portions constituting handles for grasping by the hands of a person administering C.P.R. to a victim. A first pressure pad is attached to the elongated member generally medially between the opposite end portions and includes a body engaging surface spaced laterally of the end portions to provide clearance for insuring little or no contact between the hands of a person administering C.P.R. and a patient's body in contact with the pressure pad during reciprocating relative movement between the device and a patient's body.

Another aspect of the invention includes the provision of a second pressure pad attached to the elongated member generally medially between the opposite end portions and located generally opposite to and in alignment with the first pad. The second pad has a body engaging surface spaced laterally of the end portions to provide hand clearance for the person administering the choking alleviating first-aid procedure.

Other aspects relate to providing a generally flat body engageable surface to the first pad and a generally rounded body engageable surface to the second pad.

The body engageable surface of the first pad is spaced laterally closer to the handle formed on the end portions than the body engageable surface of the second pad. The end portions are preferably tubular to accommodate the hands of a person more readily and are formed with finger gripping ridges and valleys or spaced separators to accommodate the fingers of the hands of a person, the separators being located adjacent to the first pad. The device furthermore includes laterally extending stops affixed to respective end portions and spaced from the first pad for limiting the hand positioning with respect thereto. The stops are generally equidistant from the first pad so that equal pressure from the hands of a person administering the first-aid procedures may be applied therefrom to the patient. Also, the stops may be employed to limit the extent of depression of the first pad into the chest of a victim on which C.P.R. is being administered.

An additional aspect of this invention relates to the provision of indicating means for informing a user of the device that a sufficient pressure is being applied by the C.P.R. pad against a patient's body to cause a sufficient compression of the heart, such indicating means preferably including a visual indicator. Other indicating means such as an audible alarm or the like may be employed as the sole indicating means and/or with other indicating means well known in the art.

A general object of this invention is to provide an improved resuscitative device for use in applying first-aid procedures.

A particular object is the provision of an improved device for manual administration of reciprocating forces by a person to a patient suffering from cardiac arrest.

A related object is to cause the person to more effectively apply the proper forces to the patient by use of the device in accord with the invention.

Another particular object is to provide an improved device which may be used by a person for extended periods of time without causing undue fatigue of the person and without causing injury to the person or the patient.

A specific object is the provision of a device useable on patients suffering from cardiac arrest and/or choking from objects or food.

Another specific object is to provide an improved device which includes indicating means for determining the amount of pressure to be applied by the user through the C.P.R. pad against the chest of a patient.

Other objects relate to the unitary design of the device, the lack of moving parts or adjustments made on other prior art devices, the simplicity and ease of manufacture, the small, compact and light weight nature of the device, as well as the ready accessibility of the device for use without set-up or time consuming procedures used with other C.P.R. apparatus. Thus, the device in accord with this invention is simple and economical in construction, easy, durable and efficient in use, and useable for a plurality of first-aid or life saving procedures.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DESCRIPTION OF THE PREFERRED EMBODIMENT

Figure 1:
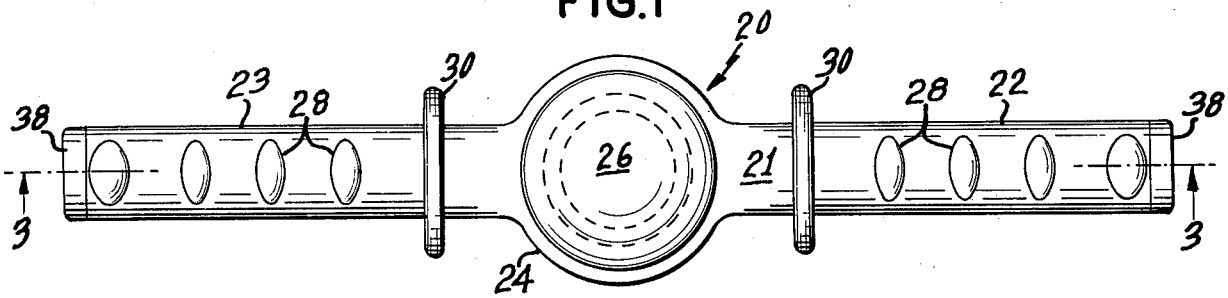
FIG. 1 is a top plan view of the resuscitative device in accord with the present invention.
Figure 2:
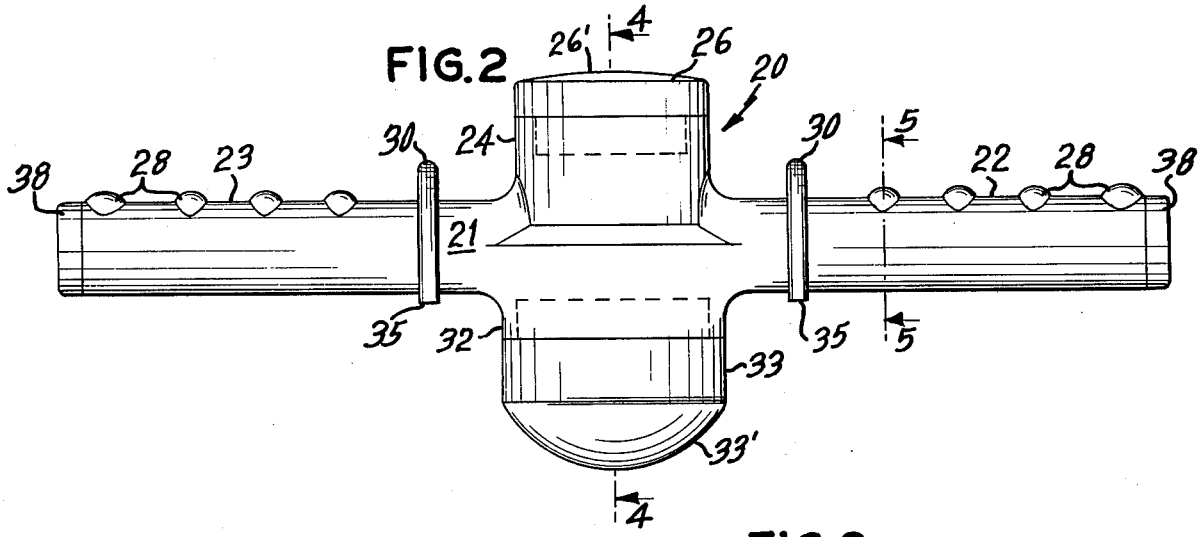
FIG. 2 is a side elevational view thereof.
Figure 3:
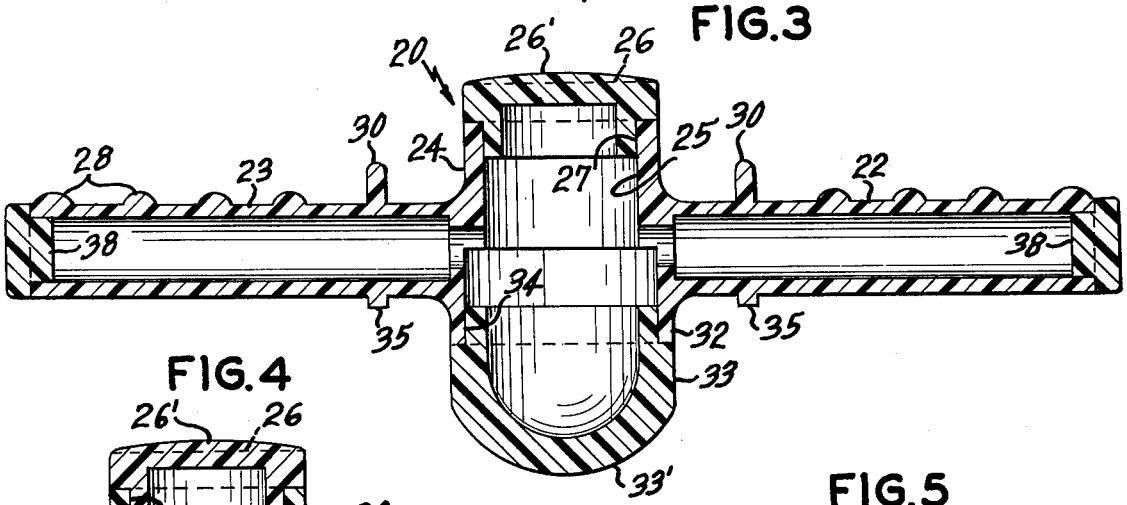
FIG. 3 is a cross-sectional view taken along line 3—3 of FIG. 1.
Figure 4:
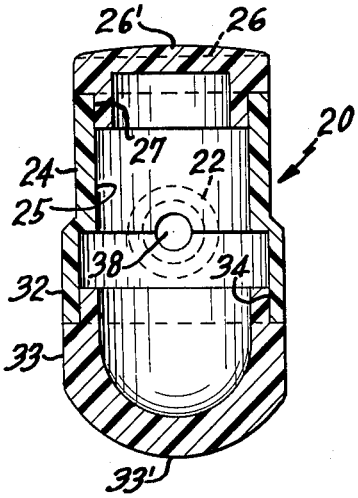
FIG. 4 is a cross-sectional view taken along line 4—4 of FIG. 2.
Figure 5:
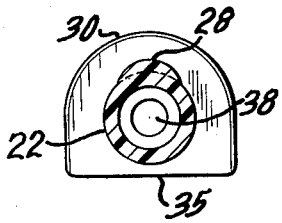
FIG. 5 is a cross-sectional view taken along line 5—5 of FIG. 2.

Referring now more particularly to the drawings of FIGS. 1–5, a resuscitative device in accord with this invention is designated by numeral 20, such device being used for emergency heart massage caused by choking, drowning, electrical shock, asphyxiation resulting in cardiac arrest whereby to resuscitate the victim, as hereinafter more fully described in connection with FIGS. 6–8.

Device 20 comprises an elongated base member 21 formed from stiff and durable plastic material, such as A.B.S. (acrylonitrile-butadiene — styrene) member 21 having opposite tubular end portions 22 and 23 constituting handles for grasping by the hands of a user who may be a novice or skilled in emergency procedures or even a highly skilled doctor. Unitary with the handles 22 and 23 is a laterally extending central cylindrical portion 24 having a hollow 25 therein with a pressure pad 26 being firmly seated in such hollow 25 in manner to seal the outer open end 27 of the cylindrical portion 24. If desired a sealing glue may be used to bond pad 26 to the base member 21 in any well known manner. Pad 26 is preferably of a slightly compressible material but relatively hard and non-slippery so that when the pad is placed against the victim's sternum, and even when wet, the pad will not slip during reciprocating relative movement between the device and the patient's body. The material used for the pad 26 permits an effective pressure to be transmitted from the user through the device and pad onto the victim's sternum in accord with accepted cardio-pulmonary resusitative procedures without bruising or causing injury to the patient. Also, the surface 26 may be slightly roughened to increase surface contact to further inhibit slippage thereof. A suitable material for pad 26 is Kraton, a plastic material made by Shell Oil Co., and is a butadiene based thermoplastic, but other known materials may be employed without departing from the spirit or scope of the invention.

The pad 26 includes a relatively flat body engageable surface 26 which is spaced laterally of the handles 22 and 23 whereby sufficient clearance is provided between the body of the patient and the hands of the user when wrapped around handles 22 and 23. Spaced separators 28 are located integral with tubular end portions 22 and 23 to require the user to appropriately grip the handles in an effective and force distributive manner. As seen the separators 28 extend laterally of the handles 22 and 23 in the same lateral direction of pad 26, since it is important to locate the hands properly if effective and less fatiguing C.P.R. is to be administered by use of this device 20.

Equidistantly located on either side of pad 26 are a pair of laterally extending stops 30 formed unitarily on member 21 which function to limit the position of the hands with respect to pad 26. Thus, the user is able to properly position his hands and not locate too near the pad 26 or the cylindrical portion 24 which would cause the hands to interfere with the proper application of C.P.R. and possibly cause damage by the hands, for example, to the ribs of the victim. Furthermore, the lateral extent of the stops 30 are determined to abut against the body of the patient to inhibit too great a force or depression by the pad 26 into the victim's sternum.

Oppositely disposed with respect to cylindrical portion 24 and its attached pad 26, is another cylindrical portion 32 and another pressure pad 33 similarly capping the open end 34 of portion 32, as previously described in connection with pad 26 capping open end 27 of portion 24. Pad 33 has a generally rounded body engaging surface 33' for engagement with the abdomen of the patient just below the rib cage in accord with the Heimlich Maneuver for choking patients. The bulbous pad 33 can be made of the same material as pad 26 and can even be made stiffer or less yielding. However the bulbous pad 33 is helpful in administering the initial pre-cardial thump to the sternum of the patient before beginning the normal C.P.R., i.e., the sternum is first struck sharply with the heel of hand engaging the bulbous pad 33 transmitting the force directly through the device and pad 26 to the sternum. Also, the bulbous pad 33 can be gripped by one hand of the user and C.P.R. may be effectively and directly transmitted through pad 33, portion 34, and into portion 23 and out through pad 26 into the patient's chest and heart. It is to be understood that either pad 26 or 33 can be used for C.P.R. particularly on large busted females and other irregular shaped chests or sternums.

Since a greater inward depression of pad 33 is permitted into the body adjacent the abdomen just below the rib cage without damaging the patient, it is preferred that surface 33' be located a greater distance laterally from the handles than surface 26' of pad 26. Furthermore, the extent of the maximum depression should not be limited by stops 30 whereby stops 30 terminate closely adjacent handles 22 and 23, i.e. the hands of the user wrapped around the handles 22 and 23 will engage the body of the patient prior to any engagement by stop edges 35.

Each of the hollow handles 22 and 23 are closed by plugs 38 in a manner similar to pads 26 and 33 closing respective cylindrical portion 27 and 34. Thus the entire hollow portions of device 20 have air encased therein to increase the buoyancy thereof rendering the device easily recoverable from an inadvertent dropping of the device in water. Also, the device may be used by one swimmer applying C.P.R. to a victim being rescued by another swimmer.

Figure 6:
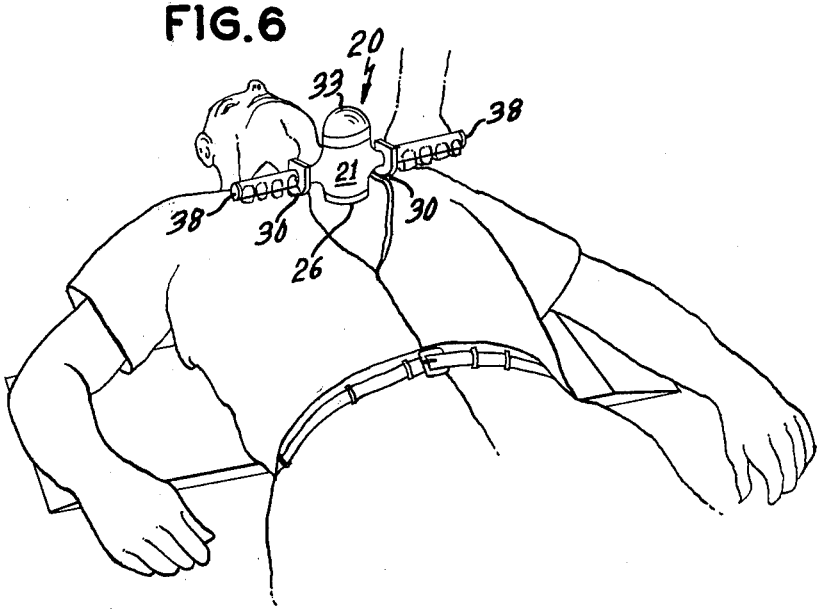
FIG. 6 is a perspective view of the device of FIG. 1 showing the operative positioning thereof being manually applied to a patient for cardio-pulmonary resuscitation.

FIG. 6 depicts the device 20 in operative position with pad 26 on the victim's sternum after the pre-cardial thump is administered. It is initially to be noted that the user may position himself to straddle the victim with the device 20 extending across the victim's body, as illustrated in FIG. 6, or the device 20 could be rotated 90° so that the device is aligned head to toe with the user alongside of the victim. Presently, the generally accepted manual method of applying C.P.R. is by rhythmic compression of the sternum above the heart once per second and intermittent mouth-to-mouth respiration. For those skilled in the art who have had to give C.P.R. for even 30 minutes, it will be apparent as to how less fatiguing the use of this device would be than by the use of the flattened heel of one hand making sure that the fingers are arched back to prevent rib damage during manual C.P.R. procedures. Furthermore, by the use of device 20, the bulbous pad 33 may be held by one hand of the user while the second hand is being used to steady the user, for example, in an ambulance, and such user can effectively apply C.P.R. Field tests of using the device 20 by trained rescue personnel, by nurses and doctors have confirmed that even the one hand application of C.P.R. is more effective in administering C.P.R. while being less tiring on the user. Also, persons of slight frame have difficulty in hand compressing the sternums of victims, particularly, victims of large frames, but even such persons can effectively apply sufficient force by the use of two hands and their own body weight through use of device 20.

Figure 7:
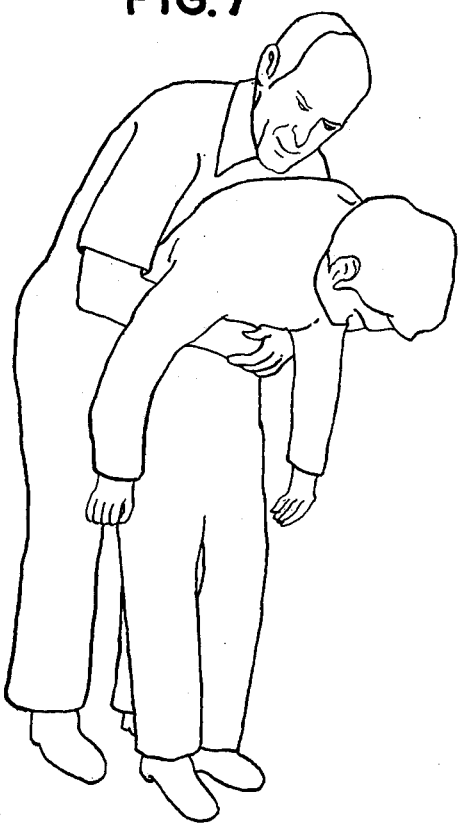
FIG. 7 is a perspective view of a trained person employing the prior art Heimlich Maneuver procedures to expel objects or food from a choking patient.
Figure 8:
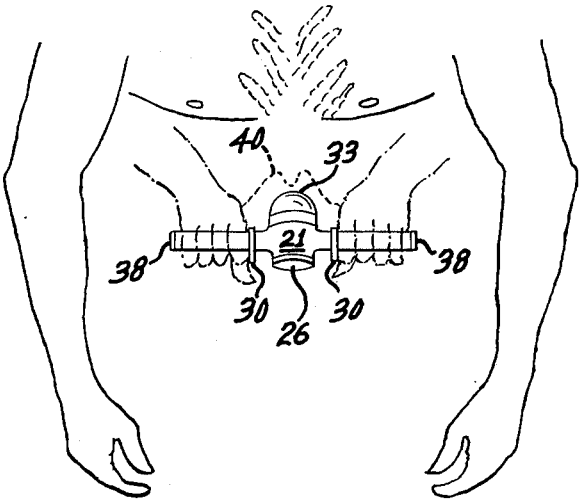
FIG. 8 is a partial view of a choking patient showing the operative positioning of the device of FIG. 1 being manually applied to a choking patient in accord with the prior art Heimlich Maneuver procedures.

FIG. 7 illustrates the prior art Heimlach Maneuver for a victim in upright position, it being understood that the victim can be sitting in a chair, for example. The fist of the person is placed against the victim's abdomen slightly below the rib cage and above the navel with the other hand grasping the person's fist. The fist is forced inwardly and upwardly in a quick and forceful thrust to cause the choking victim to expel the food or other object that occluded the airway. The same prior art procedures can be more effectively applied by the use of device 20, as illustrated in FIG. 8, with the bulbous pad 33 located slightly below the rib cage, shown by broken lines 40. Again even with slight frames, for example, an eighty pound waitress of about 5 foot height would be able to perform the Heimlich Maneuver on a victim weighing 250 pounds with the assistance of device 20. Not only can device 20 be used to perform the Heimlich Maneuver in the manner described by its originator, Dr. Henry J. Heimlich, but the victim may be prone in a face down condition and even may be used in similar procedures to apply first aid emergency treatment to drowning victims.

Figure 9:
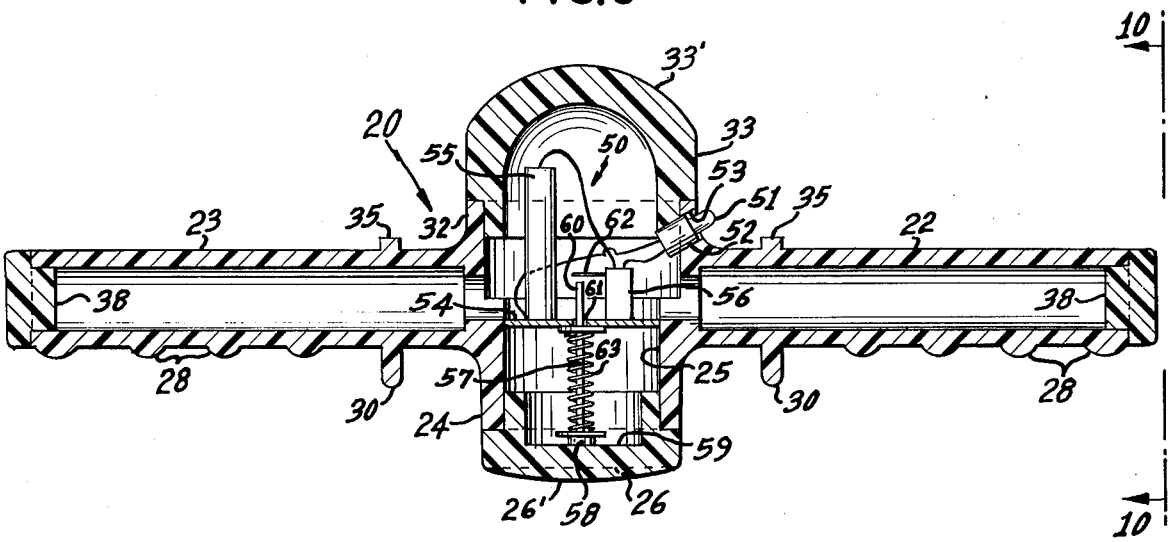
FIG. 9 is a cross-sectional view, similar to FIG. 3, showing an improved resuscitative device in accord with the present invention.
Figure 10:
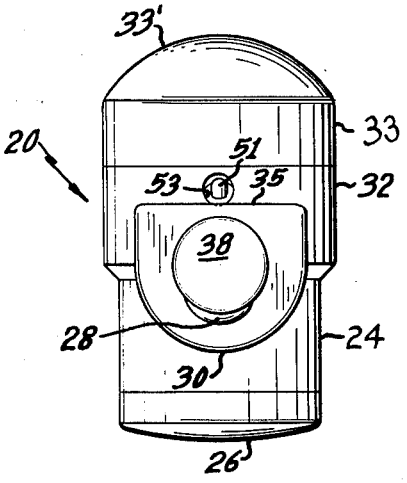
FIG. 10 is an end elevational view taken along line 10—10 of FIG. 9.

An improved resuscitative device 20 is depicted in FIGS. 9 and 10, wherein like numerals designate indentical structures shown and described in connection with FIGS. 1-5, device 20 including means 50 for indicating when a sufficient pressure is being transmitted from the user of the device through pad 26 onto the victim's sternum. Accepted C.P.R. procedures requires sufficient pressure to depress an adult's lower sternum a minimum of between 1.5 and 2 inches in order to effectively compress the heart. The pressure or force required to so compress the heart is between 80 and 120 pounds with substantially less pressure being recommended for children. Thus, the means 50 of this invention is designed to respond or indicate when 80 pounds of pressure is achieved as the minimum for adults and as a maximum pressure warning for children to inhibit irreparable injury thereto as would occur to persons skilled in the art of C.P.R. administration.

Means 50 includes a bulb or visual indicator 51 housed in a receptable 52, receptacle 52 being suitably mounted in an opening 53 extending through cylindrical portion 32. Indicator 51 is thus exposed externally of the device so that the user thereof may view the excitation of the indicator upon an appropriate force being applied by the user through the device. A support 54 is affixed to and within cylindrical portion 25 generally medially disposed between pads 26 and 33. Mounted on support 54 is a battery source 55 electrically connected to indicator 51 and switch means in the form of a microswitch 56 is also mounted on support 54 and coupled between source 55 and indicator 51 for controlling the operation thereof. An elongated plunger 57 has its lower enlarged end 58 flattened and juxtaposed against the inner surface 59 of pad 26, and has its upper end 60 extending upwardly through opening 61 in support 54 and terminating adjacent operating lever 62 of switch 56. A compression spring assembly 63 including a pair of washers and spring, is disposed surroundingly of plunger 57 between support 54 and the enlarged plunger end 58 for returning plunger 57 to its inoperative position shown in FIG. 9. When a user is administering C.P.R. with device 20 of a sufficient force to a patient, pad 26 is moved or deflected inwardly sufficiently to cause the end 60 of plunger 57 to move upwardly into contact with lever 63 thereby actuating switch 56 and lighting indicator 51. The normal spacing between end 60 and lever 62 can be adjusted in any well known manner so that indicator 51 will become actuated upon any predetermined minimum pressure necessary to provide effective C.P.R. and to avoid excessive pressure. Furthermore, the device 20 may often be used in dark conditions and the visual indicator 20 assures the user that he is applying C.P.R. in the proper manner even if such user is unskilled in the art.

Figure 11:
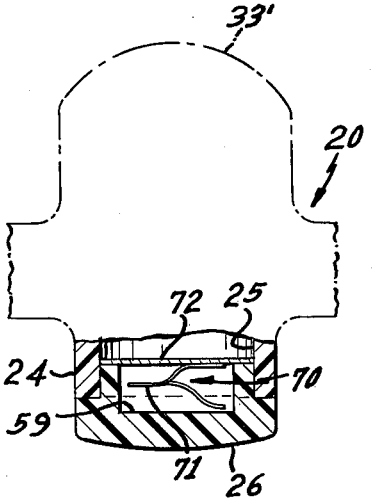
FIG. 11 is a partial cross-sectional view, similar to FIG. 9, showing another improved resuscitative device in accord with the present invention.

Another embodiment of the invention is disclosed in FIG. 11 wherein means 70 is provided for indicating when a sufficient force is being applied by the user through device 20 to a victim's sternum. Means 70 is seen to include an audible indicator 71 in the form of an internally stressed diaphragm or blade which snaps from one shape into another shape when sufficient inward deflection of pad 23 is provided by a force exerted by a user through device 20 onto the victim's sternum. Indicator 71 is located internally of the device 20 within cylindrical portion 24 and between pad inner surface 59 and support 72 affixed to cylindrical portion 24.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A resuscitative device comprising an elongated member having opposite end portions, each of said end portions constituting handles for grasping by the hands of a person, a pressure pad attached to said member generally medially between said opposite end portions, said pressure pad having a body engageable surface spaced laterally of said end portions to provide sufficient clearance between the hands of a person and a patient's body in contact with said pressure pad during reciprocating relative movement between said device and a patient's body, and laterally extending stops affixed to respective said end portions spaced outwardly from said pad for limiting the hand positioning with respect to said pad, said stops being equidistant from said pad so that equal pressure from the hands of a person may be applied.

2. In the device in accord with claim 1 wherein said end portions are tubular to accommodate the hands of a person.

3. In the device accord with claim 2 wherein said end portions include spaced separators to accomodate the fingers of the hands of a person and wherein said separators are located adjacent to said pad.

4. A resuscitative device comprising a member having opposite end portions, each of said end portions constituting handles for grasping by the hands of a person, a pressure pad attached to said member generally medially between said opposite end portions, said pressure pad having a body engageable surface spaced laterally of said end portions to provide sufficient clearance between the hands of a person and a patient's body in contact with said pressure pad during reciprocating relative movement between said device and a patient's body, and another pressure pad attached to said member generally medially between said opposite end portions and located generally opposite to said pad.

5. In the device in accord with claim 4 wherein said pad includes a generally flat body engageable surface and said other pad having a generally rounded body engageable surface.

6. In the device in accord with claim 4 wherein said body engageable surface of said pad is spaced closer to said handles than the body engageable surface of said other pad.

7. In the device as defined in claim 6 further comprising laterally extending stops affixed to respective said end portions spacedly from said pads and extending toward said pad, said stops being equidistant from said pad so that equal pressure from the hands of a person may be applied to said pad with the hands abutted against respective stops.

8. In the device in accord with claim 4 wherein said other pressure pad includes a bulbous body engaging portion, said body engaging portion being in general alignment with and facing oppositely with respect to said pad.

9. A resuscitative device comprising a member having opposite end portions, each of said end portions constituting handles for grasping by the hands of a person, a pressure pad attached to said member generally medially between said opposite end portions, said pressure pad having a body engageable surface spaced laterally of said end portions to provide sufficient clearance between the hands of a person and a patient's body in contact with said pressure pad during reciprocating relative movement between said device and a patient's body, said member being hollow with air encased therein for increasing the buoyancy thereof.

10. A resuscitative device comprising a member having opposite end portions, each of said end portions constituting handles for grasping by the hands of a person, a pressure pad attached to said member generally medially between said opposite end portions, said pressure pad having a body engageable surface spaced laterally of said end portions to provide sufficient clearance between the hands of a person and a patient's body in contact with said pressure pad during reciprocating relative movement between said device and a patient's body, and indicating means operable upon sufficient movement of said pad against a patient's body for indicating an appropriate pressure being applied by said pad to a patient's body.

11. In the device in accord with claim 10 wherein said indicating means includes a visual indicator disposed internally of the device and viewable externally of the device.

12. In the device in accord with claim 11 wherein said indicating means includes an elongated plunger within said device having one end juxtaposed to said pad, switch means adjacent the other plunger end and operable upon sufficient movement of said plunger caused by an inward deflection of said pad, said visual indicator being electrically connected to said switch means for indicating such sufficient plunger movement.

13. In the device in accord with claim 12 further comprising a battery located internally of said device and electrically coupled through said switch means to said visual indicator.

14. A resuscitative device comprising a member having opposite end portions, each of said end portions constituting handles for grasping by the hands of a person, a pressure pad attached to said member generally medially between said opposite end portions, said pressure pad having a body engageable surface spaced laterally of said end portions to provide sufficient clearance between the hands of a person and a patient's body in contact with said pressure pad during reciprocating relative movement between said device and a patient's body, and means indicative of the amount of pressure being applied by the person using the device through said pad against a patient's body.

15. In the device in accord with claim 14 wherein said means includes a visual indicator.

16. In the device in accord with claim 14 wherein said means includes an audible indicator.

17. In the device in accord with claim 4 further comprising means indicative of the amount of pressure being applied by the person using the device through said pad against a patient's body.

18. In the device in accord with claim 15 wherein said means includes a visual indicator attached internally of the device and viewable externally of the device.

19. In the device in accord with claim 18 wherein said means includes a battery source internally of the device, an electrical switch connected between said source and said indicator, means between said pad and said switch for actuating said switch upon sufficient inward deflection of said pad corresponding to a predetermined pressure being applied to a patient's body in contact with said pad.

* * * * *